US011402140B2

(12) United States Patent
San Cristobal

(10) Patent No.: US 11,402,140 B2
(45) Date of Patent: Aug. 2, 2022

(54) MODULAR REFRIGERATION SYSTEM, E.G., FOR SHIPS

(71) Applicant: BRONSWERK MARINE INC., Brossard (CA)

(72) Inventor: Augusto San Cristobal, Laprairie (CA)

(73) Assignee: BRONSWERK MARINE INC., Brossard (CA)

( * ) Notice: Subject to any disclaimer, the term of this patent is extended or adjusted under 35 U.S.C. 154(b) by 263 days.

(21) Appl. No.: 16/983,072

(22) Filed: Aug. 3, 2020

(65) Prior Publication Data

US 2020/0363113 A1 Nov. 19, 2020

Related U.S. Application Data

(63) Continuation of application No. 14/801,221, filed on Jul. 16, 2015, now abandoned.

(60) Provisional application No. 62/025,291, filed on Jul. 20, 2014.

(51) Int. Cl.
*B63J 2/12* (2006.01)
*F25B 49/02* (2006.01)

(52) U.S. Cl.
CPC ..... *F25B 49/027* (2013.01); *B63J 2/12* (2013.01); *F25B 2339/047* (2013.01); *F25B 2400/21* (2013.01); *F25B 2500/06* (2013.01)

(58) Field of Classification Search
CPC ..... F25B 2400/21; F25B 2500/06; F25B 2339/047; F25B 49/027; B63J 2/12
See application file for complete search history.

(56) References Cited

U.S. PATENT DOCUMENTS

| | | | |
|---|---|---|---|
| 4,270,363 | A | 6/1981 | Maring et al. |
| 4,356,708 | A | 11/1982 | Horton |
| 5,369,960 | A | 12/1994 | Mueller et al. |
| 2002/0139137 | A1 | 10/2002 | Tipton |
| 2003/0057396 | A1 | 3/2003 | Cawley |
| 2004/0094295 | A1 | 5/2004 | Wu et al. |
| 2006/0112705 | A1 | 6/2006 | Jin et al. |
| 2006/0123817 | A1 | 6/2006 | Song et al. |

(Continued)

FOREIGN PATENT DOCUMENTS

CN 203258924 U 10/2013

*Primary Examiner* — Filip Zec
(74) *Attorney, Agent, or Firm* — Norton Rose Fulbright Canada LLP

(57) ABSTRACT

A self-enclosed modular refrigeration unit for refrigeration system comprises compressor adapted to compress a refrigerant. A heat exchanger is connected to a cooling water network to condense the refrigerant with cooling water. A suction line is connected to a suction side of the compressor and adapted to provide a feed of refrigerant to the compressor. A discharge line is connected to a discharge side of the compressor and to the heat exchanger to direct compressed refrigerant to the heat exchanger. A head pressure control valve is in the discharge line downstream of the heat exchanger to control an upstream pressure. A casing encloses the compressor, the heat exchanger, the head pressure control valve. An outlet line has an outlet end downstream of the head pressure control valve adapted to output cooling refrigerant having passed through the head pressure control valve. An inlet end is upstream of the suction line to provide a feed of refrigerant to the compressor.

17 Claims, 3 Drawing Sheets

(56) References Cited

U.S. PATENT DOCUMENTS

| | | | | |
|---|---|---|---|---|
| 2006/0219388 | A1 | 10/2006 | Terakado et al. | |
| 2007/0039346 | A1 | 2/2007 | Yano | |
| 2008/0083237 | A1* | 4/2008 | Street | F25B 49/027 62/196.4 |
| 2008/0104971 | A1 | 5/2008 | Sami | |
| 2009/0185343 | A1 | 7/2009 | Wu | |
| 2011/0041536 | A1* | 2/2011 | O'Brien | F25B 30/06 62/238.6 |
| 2012/0075754 | A1 | 3/2012 | Jayanth et al. | |
| 2012/0103589 | A1 | 5/2012 | Sohn et al. | |
| 2012/0138270 | A1 | 6/2012 | Park et al. | |
| 2013/0186122 | A1 | 7/2013 | Hamilton | |
| 2016/0018137 | A1* | 1/2016 | San Cristobal | F25B 49/027 29/890.031 |
| 2020/0300525 | A1* | 9/2020 | Jacobi | F25B 41/24 |

* cited by examiner

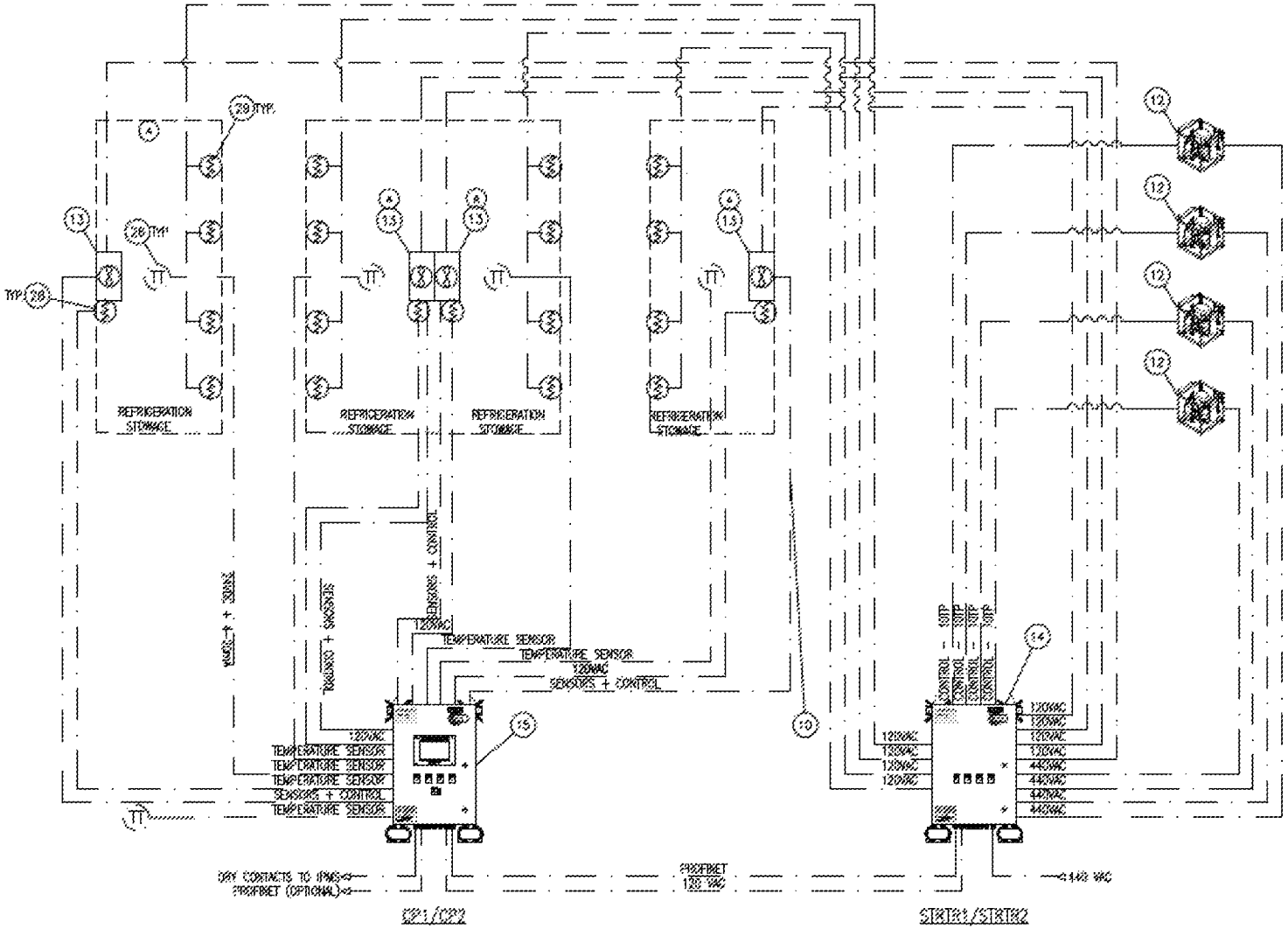
REFRIGERATION STORAGE
REFRIGERATION STORAGE
REFRIGERATION STORAGE
REFRIGERATION STORAGE
SENSORS + CONTROL
SENSORS + CONTROL
SENSORS + CONTROL
TEMPERATURE SENSOR
TEMPERATURE SENSOR
TEMPERATURE SENSOR
TEMPERATURE SENSOR
TEMPERATURE SENSOR
TEMPERATURE SENSOR
TEMPERATURE SENSOR
TEMPERATURE SENSOR
SENSORS + CONTROL
SENSORS + CONTROL
SENSORS + CONTROL

MODULAR REFRIGERATION SYSTEM, E.G., FOR SHIPS

CROSS-REFERENCE TO RELATED APPLICATION

The present application is a continuation of U.S. non-provisional patent application Ser. No. 14/801,221, filed on Jul. 16, 2015 which claims priority on U.S. provisional patent application No. 62/025,291, filed on Jul. 16, 2014, incorporated herein by reference.

TECHNICAL FIELD

The present disclosure relates to water cooled refrigeration systems of the type used in ships, for instance with sea water or fresh water.

BACKGROUND OF THE ART

Refrigeration systems as found in ships commonly use sea water or fresh water as condenser fluid to absorb heat from a refrigerant in a refrigeration cycle. In order to control the compressor head pressure in such refrigeration systems, the flow of cooling water to the condenser is controlled. This arrangement, although quite efficient, requires various connections between a packaged refrigeration unit and the sea or fresh water network.

Due to the extended periods offshore, adequate refrigeration is required for ships to stay operational. Indeed, due to the various refrigeration needs of vessels, for instance to keep foodstuff inventory fresh, to operate air conditioning cycles or to cool storage facilities for garbage, large stand-by refrigeration systems are needed. Ships often need to return to shore to get servicing or repair refrigeration systems. Indeed, due to the complexity of known packaged refrigeration units, specialized personnel is required to repair or replace packaged refrigeration units.

SUMMARY

It is an aim of the present disclosure to provide a modular refrigeration system that addresses issues associated with the prior art.

Therefore, in accordance with the present disclosure, there is provided a self-enclosed modular refrigeration unit for refrigeration system comprising: at least one compressor adapted to compress a refrigerant; a heat exchanger adapted to be connected to a cooling water network to condense the refrigerant with cooling water; a suction line connected to a suction side of the compressor and adapted to provide a feed of refrigerant to the compressor; a discharge line connected to a discharge side of the compressor and to the heat exchanger to direct compressed refrigerant to the heat exchanger; a head pressure control valve in the discharge line downstream of the heat exchanger to control an upstream pressure; a casing enclosing the compressor, the heat exchanger, the head pressure control valve; an outlet line having an outlet end downstream of the head pressure control valve adapted to output cooling refrigerant having passed through the head pressure control valve; and an inlet end upstream of the suction line adapted to provide a feed of refrigerant to the compressor.

In accordance with a further embodiment, there is provided a watercraft comprising: the self-enclosed modular refrigeration unit described above, the cooling water network connected to the heat exchanger for circulating cooling water in the heat exchanger; an enclosure to be refrigerated; and a refrigeration unit cooler permanently in the watercraft and having an inlet connectable to the outlet line of the self-enclosed modular refrigeration unit for receiving cooling refrigerant, an expansion valve, an evaporator coil in the enclosure and an outlet connectable to the suction line of the self-enclosed modular refrigeration unit for returning refrigerant to the self-enclosed modular refrigeration unit.

In accordance with yet another embodiment, there is provided a method for replacing a modular refrigeration unit with another, comprising: closing a fluid communication between a refrigerant receiver of a first modular refrigeration unit and an evaporator; operating a compressor of the first modular refrigeration unit upstream of the refrigerant receiver to collect refrigerant in the refrigerant receiver; upon reaching a given level of refrigerant in the refrigerant receiver, stopping the compressor; closing a fluid communication between the evaporator and the compressor; disconnecting a refrigeration circuit of the first modular refrigeration unit from a circuit of the evaporator, and a heat exchanger of the first modular refrigeration unit from a cooling water network; and replacing the first modular refrigeration unit with a second modular refrigeration unit; wherein the steps are performed in any appropriate order.

DESCRIPTION OF THE DRAWINGS

FIG. 1 is a schematic view of a plurality of modular refrigeration systems relative to refrigerated enclosures;

DETAILED DESCRIPTION

Figure 2:
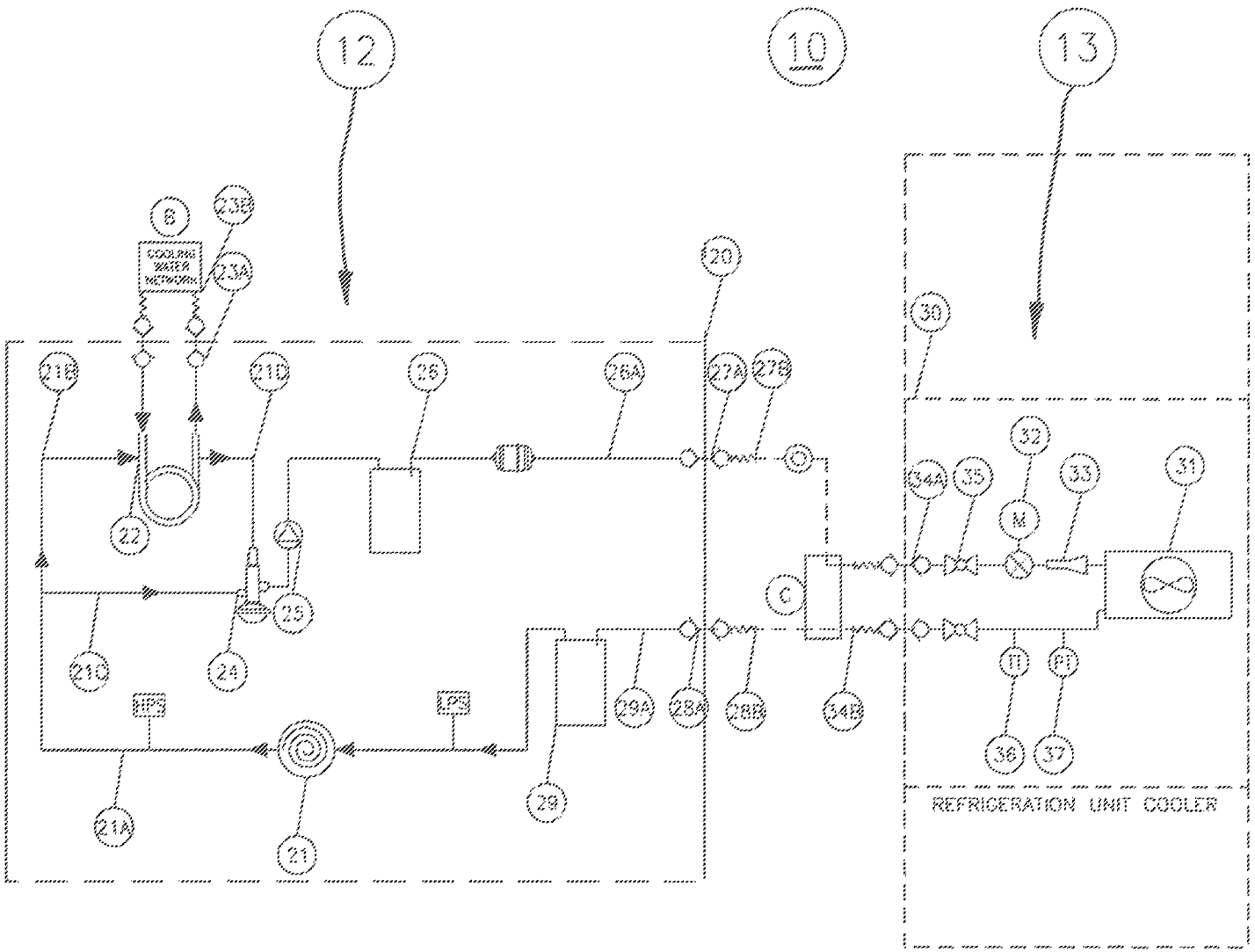
FIG. 2 is an enlarged schematic view of a modular refrigeration system in accordance with the present disclosure.

Referring to the drawings and more particularly to FIG. 1, there is shown a plurality of modular refrigeration systems 10 used to cool refrigerated enclosures A, with each of the modular refrigeration systems 10 comprising a modular refrigeration unit 12 and a refrigeration unit cooler 13 that is integral to a watercraft. The refrigerated enclosures may be for any appropriate refrigerating use, such as storage of foodstuff, garbage, etc. The refrigerated enclosures A (stowages) are part of a watercraft such as a boat, a vessel or a ship, although other uses are contemplated as well. By way of example, a refrigeration starter is shown at 14 while a refrigeration control is shown at 15, and are typically provided to control the operation of the modular refrigeration system 10 and, more particularly, of the modular refrigeration unit 12 and the refrigeration unit cooler 13. The refrigeration starter 14 and the refrigeration control 15 are one contemplated solution to operate the modular refrigeration systems 10 from a central location, but it is contemplated to operate the modular refrigeration systems 10 in a decentralized manner, at each of the units 12, for example. The electrical connections between the removable modular refrigeration unit 12 and the permanent refrigeration unit cooler 13, refrigeration starter 14 and refrigeration control 15 is not discussed. However, it is considered to have many components of the electric circuit be part of the vessel, and the electrical connections are configured for easy connection and disconnection by maintenance personnel.

The modular refrigeration unit 12 is a self-enclosed unit that outputs refrigerant in a cooling (sub-cooled liquid) state, i.e., ready to evaporate and absorb heat. The modular refrigeration unit 12 forms a substantial part of the high-pressure portion of the modular refrigeration system 10, and is configured to be easily replaceable, for example without specialized tools or training.

The refrigeration unit cooler 13 receives the cooling state refrigerant and is in the refrigerated enclosure A (also known as stowage) to absorb heat from forced air (e.g., recirculated air), and hence refrigerate the refrigerated enclosure A.

Referring to FIG. 2, the modular refrigeration unit 12 and the refrigeration unit cooler 13 are shown in greater detail, in relation to one another. FIG. 2 is a schematic representation of the refrigeration components, and is hence not to scale and lacks details of electrical interconnections for clarity, which electrical connections are in part shown by FIG. 1. The modular refrigeration unit 12 and the refrigeration unit cooler 13 are part of the modular refrigeration system 10 which is in a heat exchange relation with a cooling water network, generally shown as B in FIG. 2. Although the expression "sea water" is used, the source of water is that of waters upon which the ship navigates, i.e., not necessarily a sea, and hence includes fresh water as well. The cooling water network B is part of the ship, and provides a flow of cold water. The modular refrigeration unit 12 is connectable to an inlet and outlet of the cooling water network B, for cooling water to circulate in and out of the modular refrigeration unit 12, as described hereinafter.

The modular refrigeration unit 12 is delimited by a casing 20. The casing 20 is of relatively compact size (for instance, 18" by 18" by 18" although other dimensions are considered) and may be a plug-and-play modular seawater-cooled system. According to an embodiment, all modular refrigeration units 12 of a same ship have a standardized capacity with same casing size, i.e., all modular refrigeration units 12 are the same, in such a way that a replacement modular refrigeration unit 12 may be used to replace any of the installed modular refrigeration units 12, whereby there is no need to carry an inventory of different sizes of modular refrigeration units 12.

Enclosed in the casing 20 is a compressor 21. The compressor 21 may be any appropriate compressor of suitable capacity to meet the load requirements of the modular refrigeration unit 12. However, due to size restrictions in the casing 20, it is considered to employ a hermetic reciprocating compressor, or a scroll compressor, that can provide capacity of 0.6 ton in a low temperature applications, although it is contemplated to have larger capacities for other applications, such as air-conditioning for example. The compressor 21 is used to compress refrigerant, such as a synthetic refrigerant or any other appropriate refrigerant, to a relatively high pressure gas state. A line 21A extends from the discharge of the compressor 21 and diverges into lines 21B and 21C. Line 21B directs at least a portion of the compressed refrigerant to a condenser 22, which consists of a heat exchanger in which the hot gas refrigerant is in a heat exchange relation with cooling water (i.e., condenser coolant) from the network B. Accordingly, cooling water from the network B circulating in the condenser 22 absorbs heat from the hot gas refrigerant. The condenser 22 is for instance a coaxial water-cooled condenser for its compactness, although other types of heat exchangers could be used as well. In order to facilitate the connection of the condenser 22 to the cooling water network B, an appropriate set of valves 23A is provided in the incoming and outgoing cooling water lines and at the inlet and outlet of the condenser 22, so as to disconnect the portion of the cooling water network B extending into the modular refrigeration unit 12. Moreover, to facilitate the connection between the modular refrigeration unit 12 and network B, flexible pipes 23B may also be provided in the incoming and outgoing coiling water lines, for instance with quick coupling connections.

A pressure-control device 24, such as head pressure control valve, is downstream of the condenser 22, and is a converging point for lines 21D and 21C. Accordingly, refrigerant discharged from the compressor 21 may either pass through line 21B to reach the condenser 22 and subsequently head to the head pressure control valve 24 via line 21D, or bypass the condenser 22 via line 21C to reach the head pressure control valve 24. It is the head pressure control valve 24 that controls the amount of refrigerant going through each of lines 21B and 21C. Accordingly, valve 24 performs head pressure control of the refrigerant discharged by the compressor 21, by selectively allowing some refrigerant to bypass the condenser 22. The valve 24 operates as a function of the refrigerant discharge pressure and the temperature of the cooling water circulating in the condenser 22. For instance, the colder the cooling water circulating in the condenser 22, the more the refrigerant will be bypassed via line 21C. Hence, the valve 24 controls the head pressure mechanically based on two parameters in the casing 20, i.e., discharge pressure and condenser temperature. The valve 24 may thus operate without necessitating a feed line connected to the network B outside of the casing 20, other than the connection of the condenser 22 to the network B as described above. According to an embodiment, the valve 24 may be a head pressure control valve originally designed to stabilize air cooled condensing units at high and low ambient temperatures. The mixture of refrigerant at the outlet of the valve 24 has thus released heat and is in a cooling state, although in a relatively high pressure.

A check valve 25 may be provided downstream of the valve 24 to ensure unidirectional flow of the refrigerant circulating in the modular refrigeration unit 12. A receiver 26, for example with pressure relief protection, gathers the refrigerant that is in the cooling state, for subsequently feeding same to the refrigeration unit cooler 13. A line 26A then extends to the exterior of the modular refrigeration unit 12, with a view to feeding the refrigeration unit cooler 13 with refrigerant in the cooling state. Again, an appropriate set of valves 27A is provided to facilitate connection and disconnection of lines to the inlet and outlet of the modular refrigeration unit 12. It may also be desired to use flexible pipes 27B to facilitate the connection of the modular refrigeration unit 12 to an existing pipe network.

In the return line of the modular refrigeration unit 12, i.e., downstream of the refrigeration unit cooler 13, a similar set of valves 28A may be used to facilitate disconnection of the modular refrigeration unit 12 from the existing pipe network, which may include flexible pipe 28B. An additional receiver 29, for instance a suction accumulator, is upstream of the compressor 21, and ensures that gas refrigerant is fed to the compressor 21, as opposed to liquid refrigerant, especially during defrost cycles. For instance, a suction line may be at the top of the receiver 29 to collect gaseous refrigerant. The suction accumulator 29 is in line 29A. Other components may be used, some of which are shown in FIG. 2, such as a sight glass, high pressure and low pressure switches, liquid line filter dryer, alternative condenser water regulating valve for head pressure control on special applications, among numerous other components that may be part of standard refrigeration systems.

Still referring to FIG. 2, the refrigeration unit cooler 13 receives the refrigerant on the cooling state from the modular refrigeration unit 12, to use the refrigerant for refrigeration purposes. The refrigerant is then returned to the modular refrigeration unit 12. The network of pipes connecting the modular refrigeration unit 12 to the refrigeration unit cooler 13 is generally shown at C. The network of pipes C may be integral to the ship, and may also cover a non-negligible distance, although shown in FIG. 2 as being relatively short. Stated differently, the refrigeration unit cooler 13 may be located remotely from the modular refrigeration unit 12.

The refrigeration unit cooler 13 is shown as being enclosed in a casing 30. The casing 30 comprises a unit cooler 31 that is responsible for cooling an enclosure. The unit cooler 31 typically comprises a coil in which circulates the refrigerant in the cooling state, with a fan blowing air on the coil, although other configurations are considered depending on the use of the refrigeration unit cooler 13. Accordingly, by convection, the air passed over the coil will be cooled by the refrigerant circulating in the unit cooler 31. The components associated with the unit cooler 31 include an expansion valve 32, for instance an electronic one, that will lower the pressure of the cooling-state refrigerant to enable same to reach a suitable pressure to evaporate and absorb heat from air blown thereon in the unit cooler 31. For example, in spite of the unique sizing of the modular refrigeration unit 12, the refrigeration unit cooler 13 can be set to a wide range of temperature set points (e.g., cold or frozen) with the same equipment set up, because of the use of electronic expansion valves 32 controlling the pressure of refrigerant sent to the unit cooler 31. Other components include a refrigerant distributor 33 between the expansion valve 32 and the unit cooler 31. Networks of valves 34A may be provided on the incoming and outgoing refrigerant lines to facilitate connection to and disconnection from the network C of the modular refrigeration system 10. Flexible pipes 34B may again be used to facilitate connection and disconnection. Other components may include isolation valves 35 as well as temperature and pressure sensors 36 and 37 respectively.

The configuration of the modular refrigeration system 10 is such that the replacement of either one of the modular refrigeration unit 12 and refrigeration unit cooler 13 is relatively straightforward. To disconnect a modular refrigeration unit 12 from the modular refrigeration system 10, the valves 23A, 27A and 28A are closed to allow the disconnection of the modular refrigeration unit 12 from the cooling water network B and pipe network C. The flexible pipes 23B, 27B and 28B facilitate the disconnection by allowing movement of disconnected ends. In an embodiment, the modular refrigeration unit 12 carries the bulk of the volume of the refrigerant when disconnected. Accordingly, a pump down cycle may be operated to accumulate most of the refrigerant in the receiver 26. Valve 27A is closed to block the flow of refrigerant out of the modular refrigeration unit 12. On the other hand, valves 28A are open so as to have the compressor 21 suck in all refrigerant that is downstream of the valves 27A and in the refrigeration unit cooler 13. The refrigerant is then compressed by the compressor 21 and accumulates in the receiver 26 until the refrigeration unit cooler 13 is free of refrigerant. As an alternative embodiment, the receiver is part of the refrigeration unit cooler 13, and the compressor 21 operates to fill such a receiver and therefore empty the modular refrigeration unit 12. The valves 23A, 27A, 28A, and/or 34A are key to the modularity of the system 10, by sealing off the circuits of the cooling water network B, of the modular refrigeration unit 12, and of the refrigeration unit cooler 13, for example when the modular refrigeration unit 12 is disconnected for replacement. In the process, the valves seal the refrigeration envelope.

Figure 3:
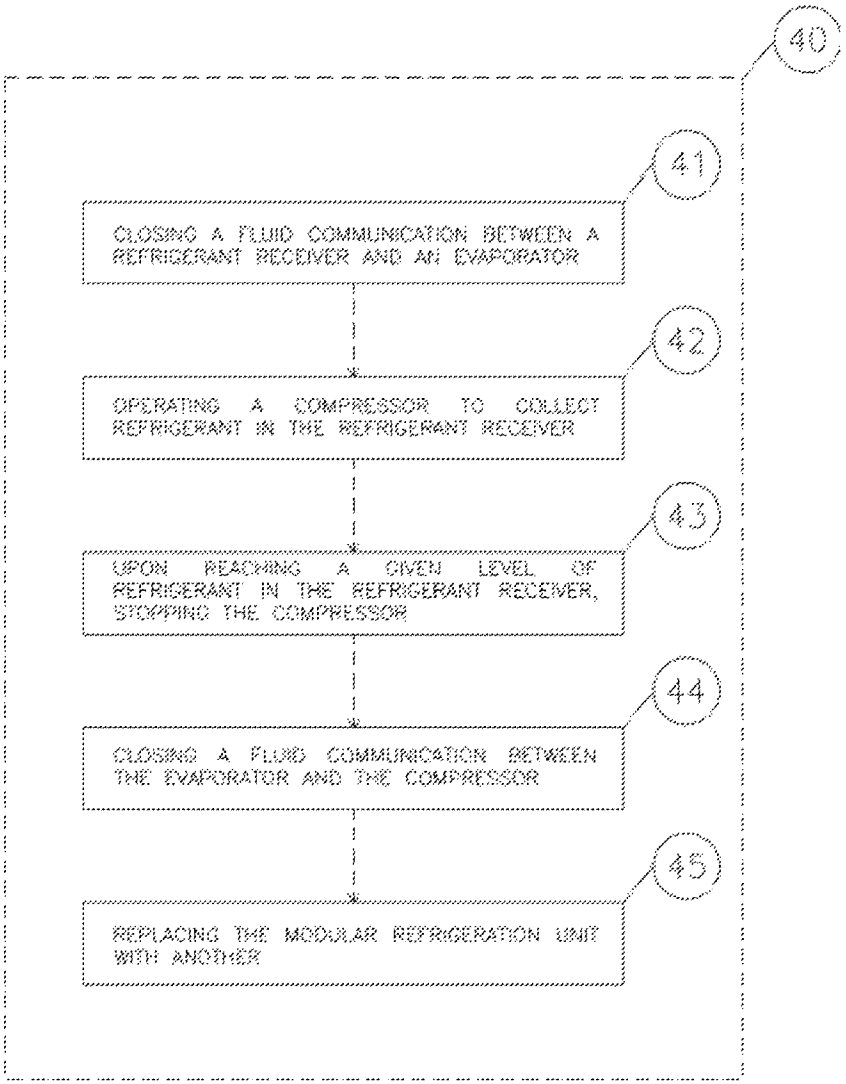
FIG. 3 is a flow chart showing a method for replacing a modular refrigeration system as in FIG. 2.

When a replacement modular refrigeration unit 12 is then installed, it will have its volume of refrigerant, while the refrigeration unit cooler 13 will be empty of refrigerant. Then, by plugging the modular refrigeration unit 12 to the refrigeration unit cooler 13 as in FIG. 2, and opening all appropriate valves 23A, 27A and 28A, the feed of refrigerant to the refrigeration unit cooler 13 will commence, and heat will be absorbed from this refrigerant by the cooling water circulating in the condenser 22. Hence, according to FIG. 3, there is provided a method 40 for replacing one of the modular refrigeration units 12 with another. According to 41, a fluid communication is closed between the refrigerant receiver 26 of the modular refrigeration unit 12 and the evaporator 31. According to 42, the compressor 21 of the modular refrigeration unit 12, upstream of the refrigerant receiver 26, is operated to condensate refrigerant in the condenser and store it in the refrigerant receiver 26. According to 43, upon reaching a given level of refrigerant in the refrigerant receiver 26, the compressor 21 is stopped. A fluid communication is then closed between the evaporator 31 and the compressor 21, according to 44. The refrigeration circuit of the modular refrigeration unit 12 are disconnected from a circuit of the refrigeration unit cooler 13, and the heat exchanger 22 of the first modular refrigeration unit is disconnected from the cooling water network B. Alternative orders of steps may be used where appropriate. Then, according to 45, the modular refrigeration unit 12 is replaced with another modular refrigeration unit 12. To replace the refrigeration unit 12, the refrigeration circuit of the second modular refrigeration unit 12 is connected to the circuit of the refrigeration unit cooler 13, and the heat exchanger 22 of the second modular refrigeration unit 12 is connected to the cooling water network B. The fluid communications between a refrigerant receiver 26 of the second modular refrigeration unit 12 and the refrigeration unit cooler 13 is opened, as is a fluid communication between the refrigeration unit cooler 13 and the compressor 21 of the second modular refrigeration unit 12. The compressor 21 may then be started. These steps are performed in any appropriate order.

The invention claimed is:

1. A self-enclosed modular refrigeration unit for refrigeration system comprising:

at least one compressor adapted to compress a refrigerant;

a heat exchanger adapted to be connected to a cooling water network to condense the refrigerant with cooling water;

a suction line connected to a suction side of the compressor and adapted to provide a feed of refrigerant to the compressor;

a discharge line connected to a discharge side of the compressor and to the heat exchanger to direct compressed refrigerant to the heat exchanger;

a head pressure control valve in the discharge line downstream of the heat exchanger to control an upstream pressure;

a casing enclosing the compressor, the heat exchanger, the head pressure control valve;

an outlet line having an outlet end downstream of the head pressure control valve adapted to output cooling refrigerant having passed through the head pressure control valve; and an inlet end upstream of the suction line adapted to provide a feed of refrigerant to the compressor.

2. The self-enclosed modular refrigeration unit according to claim 1, wherein the discharge line diverges into a subline connected to the heat exchanger and then to the head pressure control valve, and another subline bypassing the heat exchanger to be connected to the head pressure control valve.

3. The self-enclosed modular refrigeration unit according to claim 1, further comprising a closing valve at the outlet end, the closing valve being on a portion of the outlet line outside of the casing.

4. The self-enclosed modular refrigeration unit according to claim 1, further comprising a closing valve at the inlet end, the closing valve being on a portion of the suction line outside of the casing.

5. The self-enclosed modular refrigeration unit according to claim 1, further comprising a receiver in the outlet line, the receiver enclosed in the casing.

6. The self-enclosed modular refrigeration unit according to claim 1, further comprising a suction accumulator in the suction line, the suction accumulator enclosed in the casing.

7. The self-enclosed modular refrigeration unit according to claim 1, wherein the at least one compressor is one of a hermetic reciprocating compressor or a scroll compressor.

8. The self-enclosed modular refrigeration unit according to claim 1, wherein the heat exchanger is a coaxial water-cooled condenser.

9. The self-enclosed modular refrigeration unit according to claim 1, wherein open ends of the heat exchanger adapted to be connected to the cooling water network project out of the casing, and are provided with closing valves.

10. A watercraft comprising:

the self-enclosed modular refrigeration unit according to claim 1, the cooling water network connected to the heat exchanger for circulating cooling water in the heat exchanger;

an enclosure to be refrigerated; and a refrigeration unit cooler permanently in the watercraft and having an inlet connectable to the outlet line of the self-enclosed modular refrigeration unit for receiving cooling refrigerant, an expansion valve, an evaporator coil in the enclosure and an outlet connectable to the suction line of the self-enclosed modular refrigeration unit for returning refrigerant to the self-enclosed modular refrigeration unit.

11. The watercraft according to claim 10, further comprising closing valves at the inlet and at the outlet of the refrigeration unit cooler.

12. The watercraft according to claim 10, further comprising flexible pipes between the inlet of the refrigeration unit cooler and the outlet line of the self-enclosed modular refrigeration unit, and between the outlet of the refrigeration unit cooler and the suction line of the self-enclosed modular refrigeration unit.

13. The watercraft according to claim 10, further comprising closing valves at the inlet and at the outlet of the cooling water network.

14. The watercraft according to claim 10, further comprising flexible pipes between cooling water network and the heat exchanger.

15. The wartercraft according to claim 10, wherein the expansion valve is an electronic expansion valve, and further wherein a control of the expansion valve is part of the refrigeration unit couler permanently in the watercraft.

16. A method for replacing a modular refrigeration unit with another, comprising:

closing a fluid communication between a refrigerant receiver of a first modular refrigeration unit and an evaporator;

operating a compressor of the first modular refrigeration unit upstream of the refrigerant receiver to collect refrigerant in the refrigerant receiver;

upon reaching a given level of refrigerant in the refrigerant receiver, stopping the compressor;

closing a fluid communication between the evaporator and the compressor;

disconnecting a refrigeration circuit of the first modular refrigeration unit from a circuit of the evaporator, and a heat exchanger of the first modular refrigeration unit from a cooling water network; and replacing the first modular refrigeration unit with a second modular refrigeration unit;

wherein the steps are performed in any appropriate order.

17. The method according to claim 16, wherein replacing the first modular refrigeration unit with a second modular refrigeration unit comprises:

connecting a refrigeration circuit of the second modular refrigeration unit to the circuit of the evaporator, and a heat exchanger of the second modular refrigeration unit to the cooling water network;

opening a fluid communication between a refrigerant receiver of the second modular refrigeration unit and the evaporator, opening a fluid communication between the evaporator and a compressor of the second modular refrigeration unit; and starting the compressor;

wherein the steps are performed in any appropriate order.

* * * * *